US006948977B1

(12) United States Patent
Behrent

(10) Patent No.: US 6,948,977 B1
(45) Date of Patent: Sep. 27, 2005

(54) CONNECTOR ASSEMBLY AND ASSEMBLY METHOD

(76) Inventor: Bob Behrent, 23 Lincoln Dr., Flanders, NJ (US) 07836

( * ) Notice: Subject to any disclaimer, the term of this patent is extended or adjusted under 35 U.S.C. 154(b) by 0 days.

(21) Appl. No.: 10/911,790

(22) Filed: Aug. 5, 2004

(51) Int. Cl.[7] ..... H01R 9/05
(52) U.S. Cl. ..... 439/581; 439/607
(58) Field of Search ..... 439/581, 63, 607–610

(56) References Cited

U.S. PATENT DOCUMENTS

| | | | | | |
|---|---|---|---|---|---|
| 3,904,812 | A * | 9/1975 | Daffron | 174/52.3 |
| 4,391,479 | A * | 7/1983 | Wessel | 439/45 |
| 4,674,809 | A * | 6/1987 | Hollyday et al. | 439/92 |
| 4,845,593 | A * | 7/1989 | Brown et al. | 361/192 |
| 4,900,258 | A * | 2/1990 | Hnatuck et al. | 439/63 |
| 5,062,811 | A * | 11/1991 | Hackman | 439/620 |
| 5,088,937 | A * | 2/1992 | Gabany | 439/581 |
| 5,169,343 | A * | 12/1992 | Andrews | 439/608 |
| 5,730,621 | A * | 3/1998 | Wang | 439/541.5 |
| 5,851,121 | A * | 12/1998 | Thenaisie et al. | 439/63 |
| 6,045,390 | A * | 4/2000 | Metz et al. | 439/405 |
| 6,123,244 | A * | 9/2000 | Huang | 227/119 |
| 6,152,743 | A * | 11/2000 | Fox | 439/63 |
| 6,491,545 | B1 * | 12/2002 | Spiegel et al. | 439/579 |
| 6,676,443 | B1 * | 1/2004 | Wang | 439/541.5 |
| 6,776,621 | B1 * | 8/2004 | Dye | 439/63 |
| 6,793,501 | B1 * | 9/2004 | Leeman et al. | 439/63 |
| 2004/0094328 | A1 * | 5/2004 | Fjelstad et al. | 174/251 |

* cited by examiner

*Primary Examiner*—Ross Gushi
*Assistant Examiner*—Larisa Tsukerman
(74) *Attorney, Agent, or Firm*—Thomas L. Adams

(57) ABSTRACT

A connector assembly that is mountable on a circuit board includes a casing having a metallic housing. The housing has at least one receptacle where a connecting element is mounted. A shielded cable connects between the connecting element and an interconnect that is attached to the casing. The interconnect has a plurality of contact elements adapted to contact the circuit board. The metallic housing can be fitted with any one of variously colored insulating shells either during manufacture or in the field. The shell can later be slidably removed and replaced, even after the housing was attached to a circuit board. The casings can have dovetail slots that mate with dovetail ridges on an insert used to attach the casings together.

23 Claims, 8 Drawing Sheets

10
12
12A
14
16
18
19
20
21
22
24
30
32
34
35
36
37
38
40
42
44
46
48
50
52
57
58
60
60A
60B
60C
61
62
64
66
68
70
71
73
74
76
80
81
86
88
90
94
96
100

FIG. 3
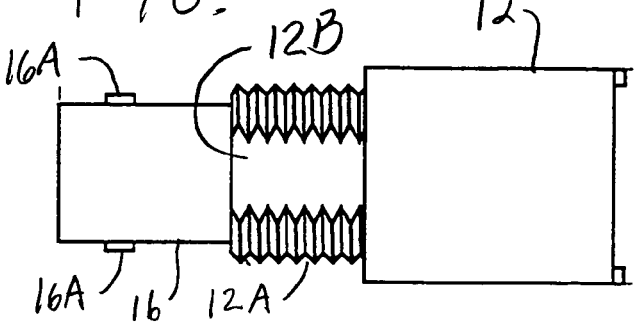
FIG. 4
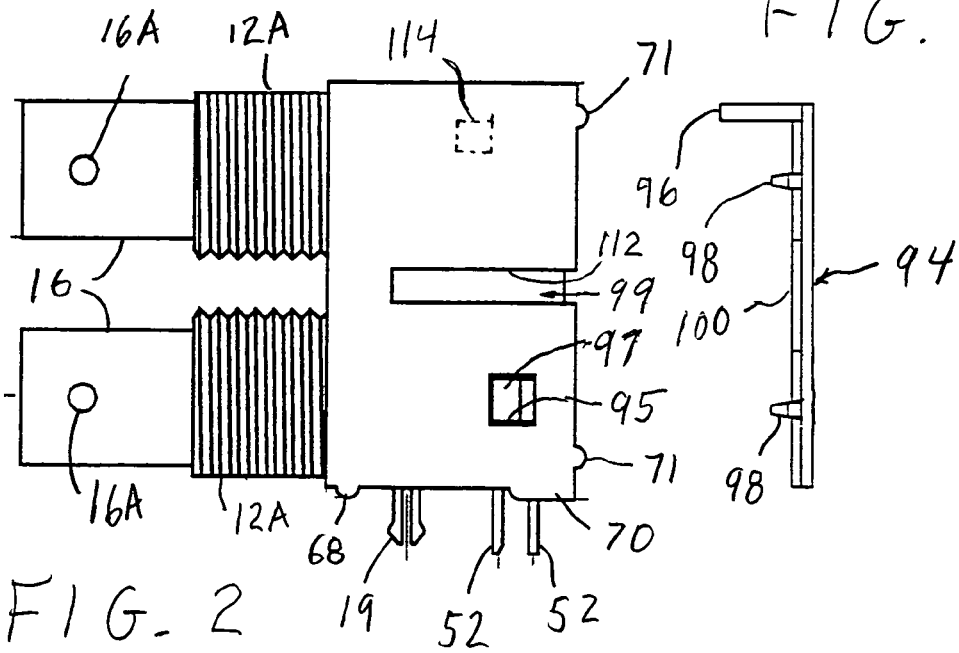
FIG. 2

106
106
104

52
54
50
32
56
51
44
46
34
60A
60B
60
60D
60C
60C
36
38
40
32
24
20
22
42

212A'
212'
338
216
338
216
327
322'
324
332
340
328
336
330
340
214
326
322'
327
281A
295'
220A
281
334

CONNECTOR ASSEMBLY AND ASSEMBLY METHOD

BACKGROUND OF THE INVENTION

1. Field of the Invention

The present invention relates to connector assemblies and assembly methods, and in particular, to devices that are adapted for various working environments.

2. Description of Related Art

Simple, reliable and effective connectors are needed in various electronic applications. Also, avoiding transmission losses and avoiding the receipt or transmission of electromagnetic interference (EMI) is important in many applications involving instrumentation, test equipment and high frequency applications handling signals such as video signals, shortwave signals, walkie-talkie signals, etc.

The problems with losses and EMI can be ameliorated with well-known shielding techniques, which include placing critical components inside a metal enclosure, and using shielded coaxial cables and shielded connectors that have a central lead surrounded by a cylindrical metal shell (for example, BNC or TNC connectors). In particular, coaxial shielded cables that have an impedance matching that of the source and destination tend to have little EMI problems or losses due to radiation, reflections or IR losses.

Applications employing multiple connectors can be especially vulnerable or prone to losses and EMI. Known compact connectors have placed a pair of connectors in a single assembly and routed wires attached to the rear of the connectors through a 90 degree turn in order to attach to contacts designed to connect to a printed circuit board. The radius of this 90 degree turn and the geometry of nearby metallic components greatly affect the losses and EMI effects, making manufacturing difficult.

Often, such connectors are mounted through a hole in a metal panel and held in place with a nut. In these cases it is often desirable to avoid multiple ground connections to such a panel in order to avoid ground loops that can be very sensitive to low-frequency interference from power mains. On the other hand, it is highly desirable to provide a high frequency ground on the panel in the vicinity of the connector to prevent the panel from acting like an antenna for the connector. For this reason, known connectors have employed a miniature capacitive element that connects between the connector's ground and the panel. For example, the capacitive element can be pressed against the connector by a metal strap or a shielding enclosure that reaches out to make contact with the back of the metal panel.

Accordingly, minimizing losses and EMI considerations place significant burdens on the manufacturers of electronic equipment who may need flexibility in arranging and efficiently placing connectors on printed circuit boards. These considerations also place significant burdens on the manufacturers of connectors who must be able to produce high-quality connectors efficiently and to develop standardized designs that can be adapted to various environments. Connector manufacturers would also like to work with castings and molds that can meet high-performance standards when necessary but can be configured to be cost-effective for less demanding environments.

In many electronic applications requiring multiple connectors, these connectors must be color-coded to help the end-users. Stocking a large number of variously colored connectors can be inefficient for manufacturers. Also, during manufacture or repair a wrongly colored connector may be inadvertently soldered onto a circuit board, which greatly increases the time required to complete manufacturing or repair.

In FIG. 2a of U.S. Pat. No. 6,042,394 the shield of cables 18 are shown adjacent to the shields 31 around each of the center contacts 15. The specification says (column 3, lines 57–58) the cables are intended to "meet impedance requirements or to avoid deteriorating reflections," without describing how or if the shields are connected.

In U.S. Pat. No. 6,679,728 a pair of mini BNC connectors are formed with a common metal case 10 having a connected pair of shielding cylinders 101 and 102. Casing 10 is described as having insert legs 107.

In one embodiment of U.S. Pat. No. 5,169,343 the outer contact parts of a column of coaxial connectors are connected to shielding cases 22 and 23. Also, the rear wall 33 of casing 23 serves as the shield for two separate inner contacts in the column of coaxial connectors. Each of the casings 22 and 23 have a separate pair of mounting pins 24. In the embodiment of FIGS. 6 and 7 a column of coaxial connectors has a common shield formed of a single metal block 49/50.

In U.S. Pat. No. 5,730,621 a pair of BNC or TNC connectors are mounted in parallel in a plastic block containing shunting capacitors 5 and 5'.

In U.S. Patent Application Publication No. 2003/0073328 a motherboard can be connected to a daughterboard by an interconnection system that has a number of twin lead shielded cables. Each of the signal leads of each pair is fitted with a spring contact that engages contact pads on the circuit boards. While FIG. 1A shows a relatively open structure, the cables can be packaged inside a unitary housing as shown in FIG. 13A.

In U.S. Pat. No. 6,234,834 connector bodies 21, 22 and 23 are stacked and held together with dovetails 224 and 232. Each of the connector bodies have four contacts in each of the three contact groups 3. In addition, a common ground is provided by contact 4 which has three arms 44 that are inserted between the contacts of each of the three groups 3. The stack is mounted inside a conductive shield 1. See also U.S. Pat. No. 6,508,665.

In U.S. Pat. No. 5,863,222 a pair of connectors are mounted on a common header 20, each having a number of contact pins 21. The back of both connectors is shielded by a grounded plate 30 that is connected to a circuit board by the tabs 38.

In U.S. Pat. No. 4,806,107 a high frequency backplane connector has several rows of connectors separated by elements 41, 42. The connectors are mounted in housing 50 and flexible circuit board 27 inside the housing connects these connectors to the pins 61–63 that in turn connect to a printed circuit board.

In FIG. 1A of U.S. Pat. No. 6,244,896 a row of RJ connectors are mounted inside a common shield 2 that has ground tab 15 for engaging shields of RJ plugs. In the embodiment of FIG. 4 an upper and lower row of RJ connectors are stacked together.

See also U.S. Pat. Nos. 5,190,461; 5,085,590; 5,921,814; 6,626,700; and 6,022,245.

SUMMARY OF THE INVENTION

In accordance with the illustrative embodiments demonstrating features and advantages of the present invention, there is provided a connector assembly having a casing with a metallic housing that has at least one receptacle. The casing is adapted for mounting on a circuit board. Also included is at least one connecting element mounted at the at least one receptacle. The assembly also has an interconnect attached to the casing. The interconnect has a plurality of contact elements adapted to contact the circuit board. Also included is a shielded cable connected between the connecting element and the interconnect.

In accordance with another aspect of the invention a connector assembly is provided with a metallic housing adapted for mounting on a circuit board. The metallic housing has at least one receptacle. Also included is an insulating shell sized to fit around the metallic housing. The insulating shell is slidably removable from the metallic housing. The assembly also has at least one connecting element mounted at the at least one receptacle. Also included is an interconnect that is attached to the metallic housing and that has a plurality of contact elements adapted to contact the circuit board. At least one of the contact elements is coupled to the connecting element.

In accordance with another yet aspect of the invention a connector assembly is provided with a pair of metallic housings each adapted for mounting on a circuit board and each having at least one receptacle. The metallic housings each have a dovetail slot. Also included are connecting elements mounted at the at least one receptacle of each of the metallic housings. The assembly also includes an insert and a pair of interconnects each attached to a corresponding one of the housings. Each of the interconnects has a plurality of contact elements, at least one of them coupled to the connecting element of a corresponding one of the housings. The contact elements are attached to the housings and are adapted to contact the circuit board. The insert has on opposite sides dovetail ridges sized to slide into the dovetail slots of the metallic housings. Thus, by means of the dovetail ridges on the insert the housings can be attached together.

In accordance with another yet aspect of the invention a connector assembly method is provided employing a plurality of variously colored insulating shells and a metallic housing having a receptacle and contact elements. The method includes the step of bringing the metallic housing to the vicinity of a circuit board. Another step is selecting one of the variously colored insulating shells and fitting it around the metallic housing. The method also includes the step of connecting the contact elements to the circuit board.

By employing assemblies and assembly methods of the foregoing type an improved connection technique is achieved. In a preferred embodiment multiple connectors are provided on a single housing formed from a single metal casting.

For example, the cylindrical metal sleeves of a pair of BNC connectors are integrally cast with a common back frame that has an open rear recess. Thin tubular sockets with springy fingers are mounted in the cylindrical metal sleeves. These thin tubular sockets are surrounded with a tubular insulator, and are fastened in place by an annular spring clip.

The proximal ends of the tubular sockets are connected to the center leads of shielded coaxial cables. These coaxial cables are routed through a recess in the back of the metal housing to an interconnect in the form of a plastic carrier holding a number of pins designed to be soldered into a printed circuit board. In particular, the center lead and the shield of the coaxial cables are separately connected to individual pins of the interconnect. The coaxial cables can be easily installed and still maintain excellent loss and EMI characteristics. In particular, the coaxial cables can be routed through the recess without the need to place them in an exact position or to maintain a precise radius of curvature. High immunity to EMI can be achieved by covering the recess containing the coaxial cables with a metal backplate.

On the other hand, the foregoing metal housing can be fitted with ordinary wire leads instead of coaxial cables for applications that do not have strict requirements on avoiding losses or EMI.

The preferred metal housing can be adapted for an even greater variety of applications by casting it with a dovetail groove on opposite sides. Then multiple housings can be ganged together with an interconnecting insert having an opposing pair of dovetail ridges designed to fit into the dovetail grooves on the metal housings. The preferred insert is a plastic plate molded with dovetail ridges on opposite sides.

Preferably, a color-coded plastic shell would be slid over the metal housing either during manufacture or at the installation site. The shells are easily replaced in the event the wrong color coding was selected. Also, the plastic shell can be chosen to accommodate embodiments where the circuit board contacts emerge to the rear or to the side. In addition the shells can be formed with openings designed to accommodate capacitive elements or the above mentioned dovetail slots. These capacitive elements are preferably held in place by a metal bracket or enclosure that extends to touch the back of a metal panel to which the connector may be attached.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 2 is a side view of the assembly of FIG. 1;

FIG. 3 is a top view of the assembly of FIG. 2;

FIG. 4 is a side view of the metal backplate in the assembly of FIG. 1;

DETAILED DESCRIPTION OF THE PREFERRED EMBODIMENTS

Figure 1:
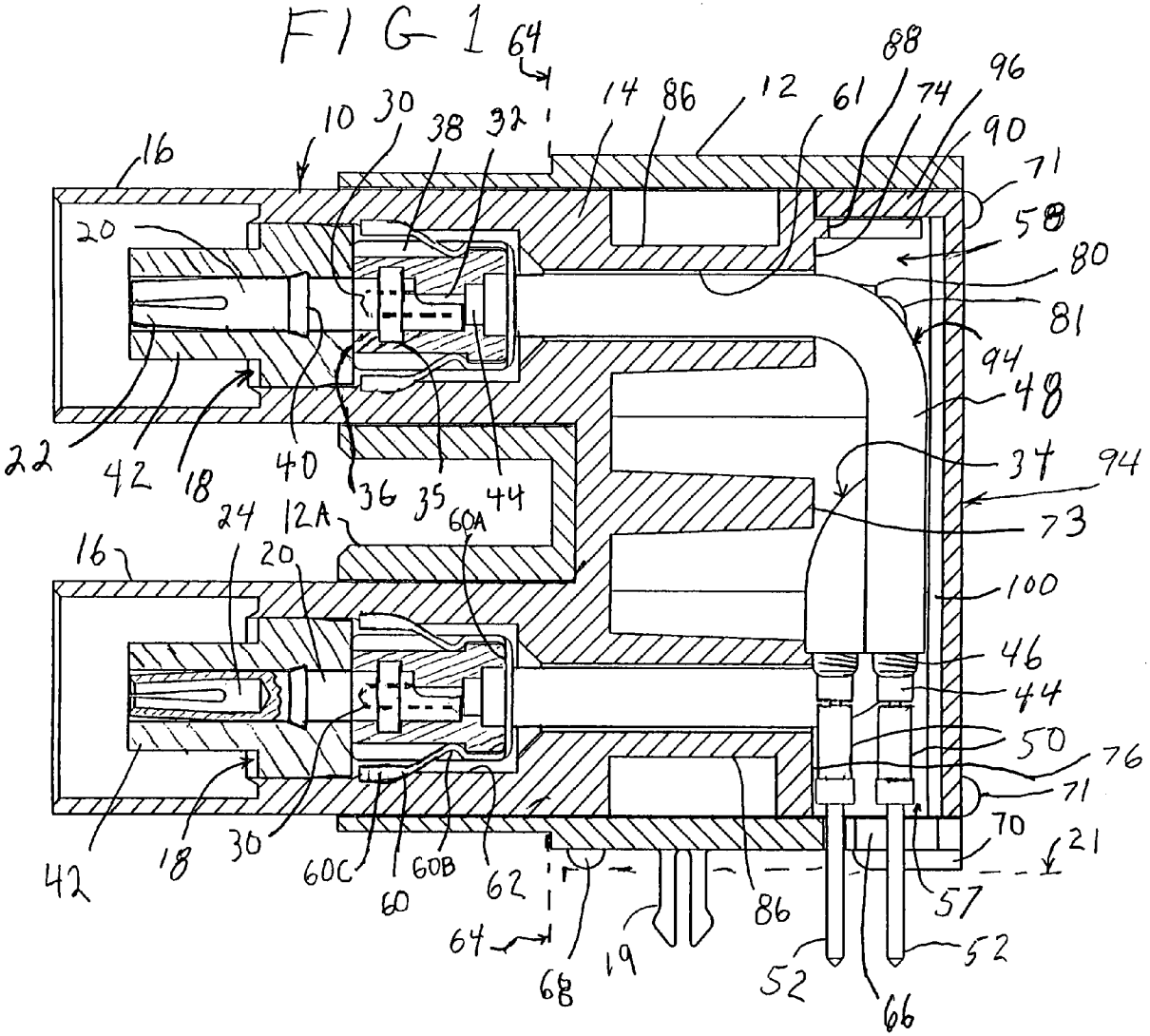
FIG. 1 is a side, cross-sectional view of a connector assembly in accordance with principles of the present invention.

Referring to FIGS. 1–8, a connector assembly is shown as a casing having a metallic housing 10 with an insulating shell 12. The housing 10 is a zinc plated steel die casting with a rear rectangular block 14 and a pair of parallel cylindrical metal sleeves 16, encompassing openings 18, herein referred to as receptacles. Sleeves 16 are each shown with an opposing pair of stubs 16A that are typically employed in BNC connectors, although it will be appreciated that the principles of the present invention can be applied to other types of connectors. Embedded in slots 17 in housing 10 are external grounding tabs 19, shown herein as bifurcated stakes designed to snap into a hole in a printed circuit board 21 (shown in phantom).

Mounted in receptacles 18 are pair of connecting elements 20 having at their distal ends four springy, longitudinal fingers 22 distributed around a cavity 24. The proximal ends of connecting elements 20 each have a wire hole 30. The central lead 32 of shielded cable 34 is soldered into wire hole 30. Molded around the junction between element 20 and cable 34 and locking onto flange 35 of element 22 is an insulating knob 36, which has a pair of diametrically opposed, stepped grooves 38.

Elements 20 have an annular barb 40 that allows insulating collars 42 to be pressed onto elements 20 into abutment with knobs 36, but not withdrawn in the opposite direction. The collars 42 are made with a uniform internal diameter but the proximal end of the collar has an outside diameter that is greater than the outside diameter of the distal end.

The connecting elements 20 can be held in place with annular clips 60 having a flat transverse annulus 60A with a pair of longitudinally extending arms having a section with an inward bight 60 that leads to a cylindrical section 60C split with bifurcations 60D. After clip 60 is placed around cable 34 and snapped into stepped grooves 38 of knob 36, cables 34 can be inserted through the receptacles 18 and the cable tunnels 61 to allow the bifurcations 60D to ride inwardly on one of the four splines 62 deep within receptacle 18. The bifurcations 60D are angled to allow insertion but resist withdrawal. The cables 34 may be previously fitted with contact elements 52/54 if they are small enough, otherwise these elements are installed after the cables routed through the tunnels 61. In this embodiment the upper one of the cables 34 makes a simple downward turn, while the lower cable makes a more complicated pigtail turn.

Shielded cables 34 are conventional coaxial cables having the previously mentioned central leads 32 encircled by an insulating sleeve 44, which is in turn surrounded by a coaxial shield 46 in the form of a copper braid covered by insulation 48. In one embodiment the shielded cables 34 were able to carry signals of 2 GHz or more, and suitably rated for 3 Ghz signals.

Figures 9, 10:
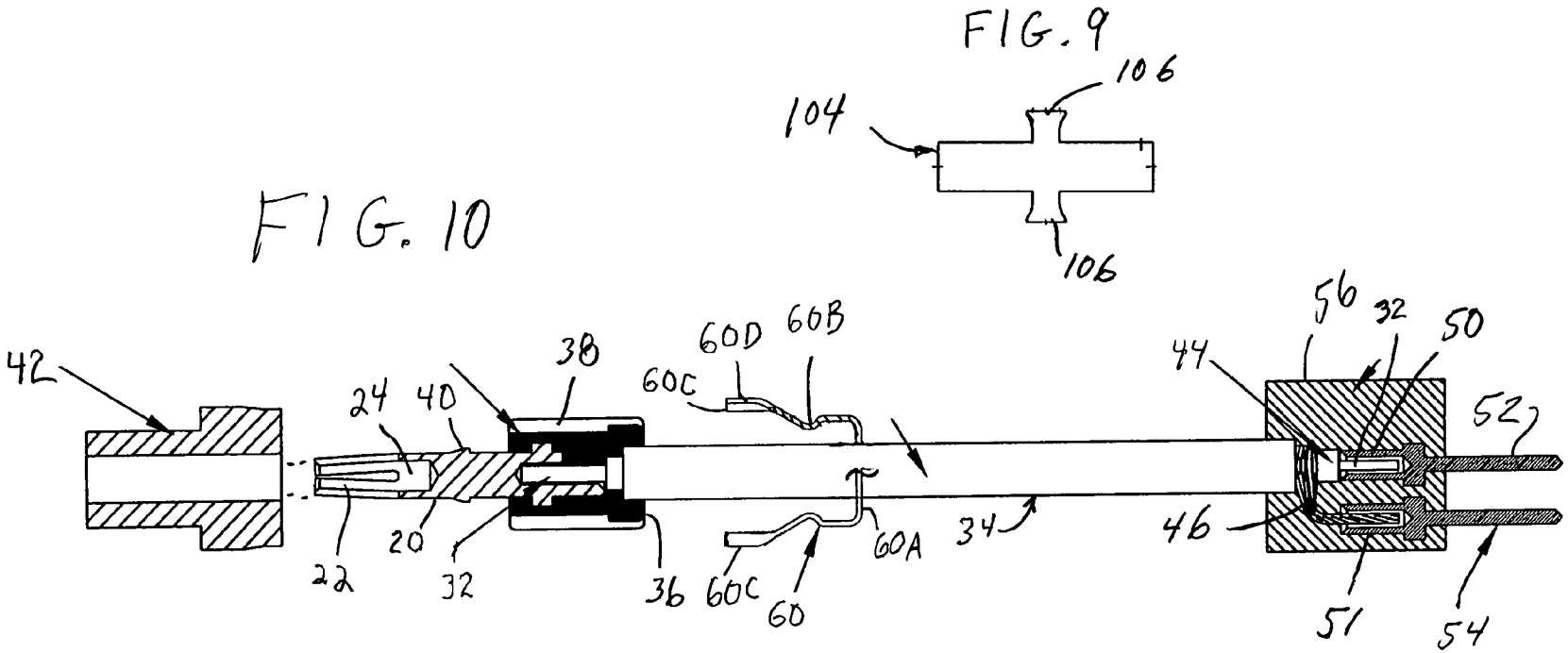
FIG. 9 is an end view of an insert that may be used to connect the housings of FIG. 1 together in groups.
FIG. 10 is an assembly diagram associated with the components of FIG. 1.

The central leads 32 at the end of cables 34 opposite connecting elements are soldered into the hollow cylindrical barrels 50 that are integral with pins 52, which are herein referred to as contact elements. As shown in FIG. 10, braid 46 is also soldered into the hollow barrel 51 of the contact elements 54, which are identical to elements 50/52.

Contact elements 52 and 54 are shown in FIG. 10 molded into a carrier 56 and the elements inside carrier 56 are referred to herein as an interconnect. In some embodiments carrier 56 may be a plastic grid with apertures sized to hold elements 52 and 54. In the embodiment of FIG. 1 the contact elements forming an interconnect (only elements 52 are visible) are not held in the hollow 57 by a separate carrier but are held in place by virtue of the stiffness of cables 34. In such an embodiment guideways or guiding ridges (not shown) in the assembly may keep the cables 34 and their braids 46 in approximately the correct position. Alternatively, the recess 58 containing cables 34 can be filled with a potting compound to hold in place the cables 34 and the contact elements 52/54 attached thereto.

Previously mentioned insulating shell 12 closely embraces the top, sides and bottom of the metallic housing 14 and its threaded barrels 12A. Barrels 12A of shell 12 cover about half the length of the metal sleeves 16 and are threaded so the assembly can be secured in a hole in a conductive panel 64 (shown in phantom) with a nut or other fastener (not shown). Shell 12 has a number of subjacent slots 66 giving clearance so that the shell can be slid onto or off the housing 14 without interference from pins 52/54 or stake 19.

A pair of front feet 68 at the front corners of shell 12 and a pair of rear feet 70 at the rear corners raise the assembly off circuit board 21, which can be important for flushing away residues that might otherwise accumulate under the assembly. As explained further hereinafter, this assembly can be assembled in such a way that the tubular sleeves 16 are perpendicular to the printed circuit board 21, in which case feet 71 on shell 12 perform a similar function of lifting the assembly off the circuit board.

Figure 6:
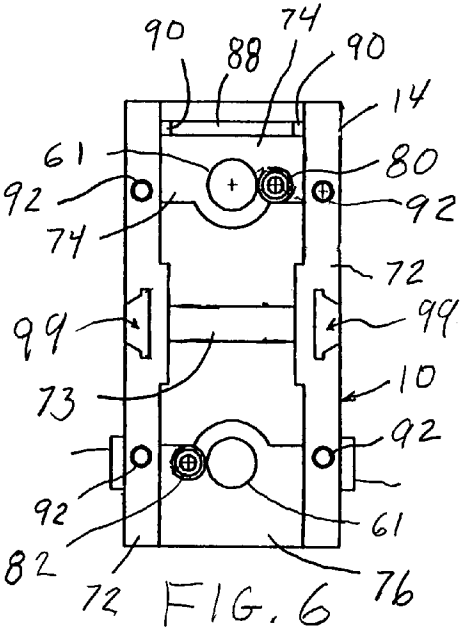
FIG. 6 is a rear view of the housing of FIG. 5.
Figure 8:
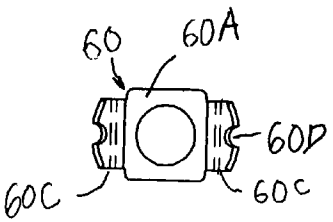
FIG. 8 is an front view of the annular clip of FIG. 1.
Figure 5:
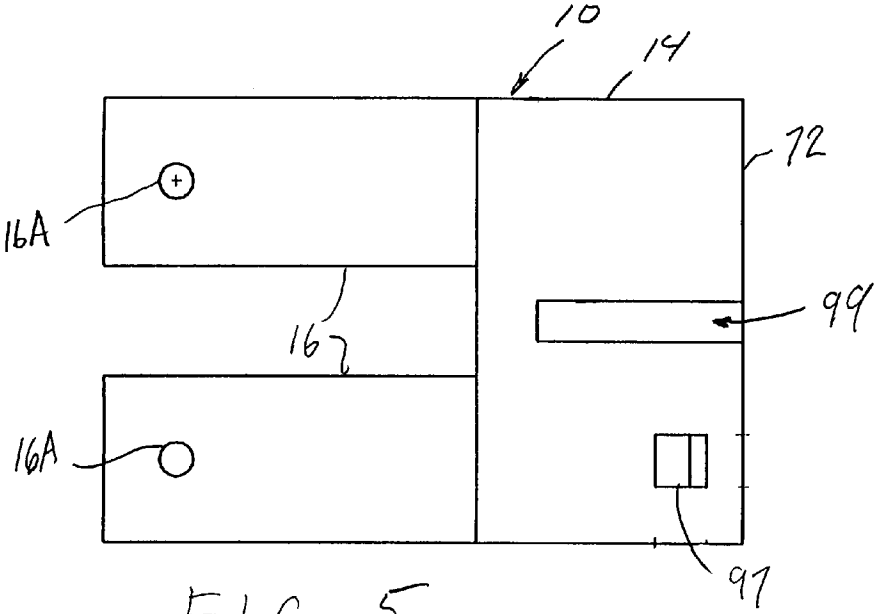
FIG. 5 is an side view of the metallic housing of FIG. 1.

The block portion 14 of housing 10 has a cross wall 73 extending between a pair of parallel side walls 72 that flank an upper plateau 74 and lower plateau 76, which plateaus are pierced by previously mentioned tunnels 61. As shown in FIG. 6, a tubular portal 80 to the right of tunnel 61 on upper plateau 74 and tubular portal 82 to the left of tunnel 61 on plateau 76 constitute the openings to grounding holes that extends through the bulk of block portion 14.

Figure 7:
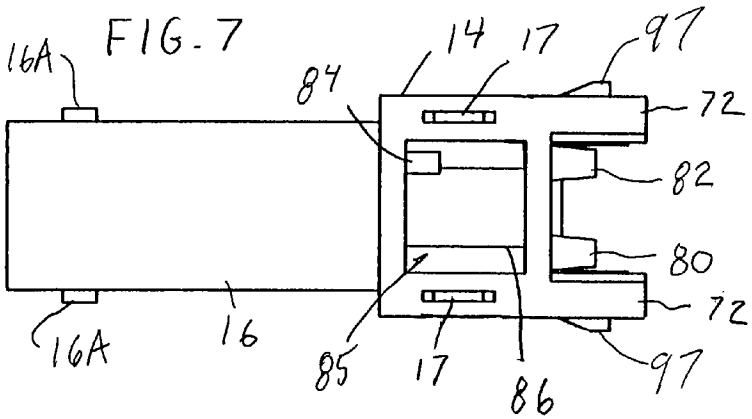
FIG. 7 is a bottom view of the housing of FIG. 5.

As shown in FIG. 7 the far end of the grounding hole of portal 82 reaches a side aperture 84 that opens into a recess 85 of block 14 having a cylindrical hump 86 containing previously mentioned tunnel 61. Another similar opening exists on the opposite side of block 14 for the grounding hole of portal 80. As described further hereinafter, in some embodiments a lead can be inserted into the grounding hole of portal 82 (and portal 80) and routed to or through opening 84 where the lead can be bent or soldered to hold it in place. In fact, a lead 81 is shown in FIG. 1 projecting from portal 80, and making a downward turn in order to attach along with pins 52 into the printed circuit board 21.

A ridge 88 (FIG. 6) extending across plateau 74 meets a spaced pair of parallel ridges 90 on the insides of walls 72. The overhang 96 (FIG. 4) of metallic backplate 94 will rest on ridges 88 and 90. Also the pins 98 on the inside of backplate 94 are inserted in the holes 92 of walls 72. In addition, the inside face of backplate 94 has a raised region 100 with an outline designed to fit snugly between walls 72.

Starting in an edge of walls 72 and running most of the length of housing block 14 are a pair of dovetail slots 99. In FIG. 9 insert 104 is shown having a center plate with a pair of opposing dovetail ridges 106 that give the insert a cruciform cross-section. The insert 104 is designed so that one of its dovetail ridges 106 can fit snugly into one of the dovetail slots 99 on housing block 14. As described further hereinafter, the other dovetail ridge on insert 104 can slide into a dovetail slot on another assembly similar to the one shown in FIG. 1. Therefore, multiple assemblies can be stacked or ganged together.

Instead of the illustrated dovetailed inserts, alternative inserts may have ridges with a cross-section having a keyhole shape, hooked shape, etc. Also, the ridge need not be one continuous element but may be a number of spaced elements. Moreover, the ridge may snap into mating groove instead of sliding. In addition, some connector assemblies may be formed with a ridge on one side and a slot on the other side so that they can be attached together without the need for a separate insert.

Located near the lower rear corner on opposite sides of housing block 14 are locking stubs 97, which are tapered so that when shell 12 is slid over housing 10 stubs 97 can enter and lock into apertures 95 in shell 12. Shell 12 also has a pair of slots 112 allowing easy access to the dovetail slot 99 in housing block 14. Shell 12 also has an optional aperture 114 designed to hold a capacitive element that will be described presently.

Figure 11:
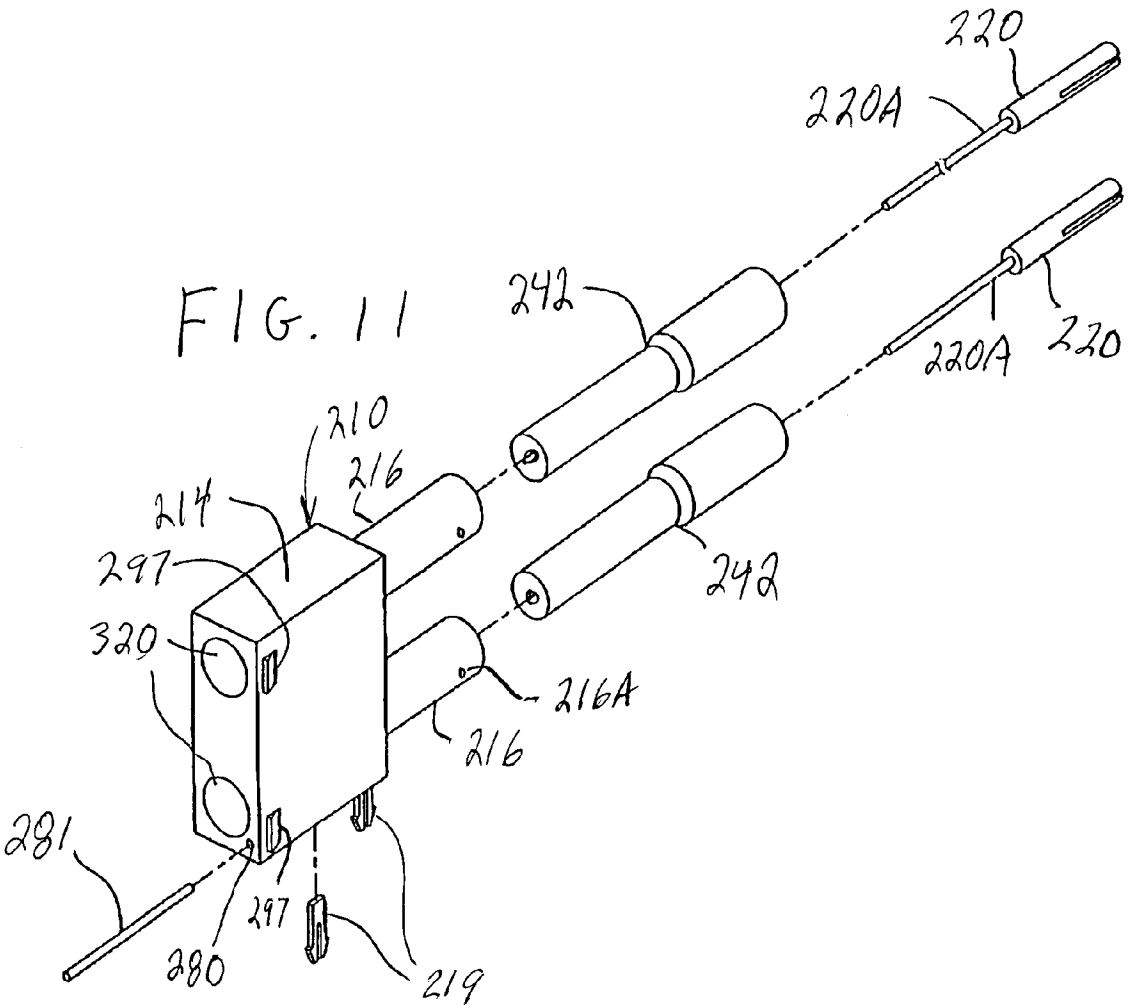
FIG. 11 is an exploded, perspective view of an assembly that is an alternate to that of FIG. 1 and which is fitted with alternate leads.

Referring to the alternate embodiment of FIG. 11, components corresponding to those previously illustrated in FIG. 1 will have the same reference numeral but increased by 200. In particular, metallic housing 210 has a rectangular block 214 supporting an integral pair of sleeves 216 with locking stubs 216A. The interiors of sleeves 216 communicate to the two openings 320 in the rear of block 214. Attached to the bottom of housing block 214 are a pair of grounding tabs 219 designed to lock into holes on a printed circuit board (not shown). Locking stub 297 at the four back corners of housing block 214 serve the same function as the previously mentioned stubs (stubs 97 of FIG. 5). Housing block 214 also has a wire portal 280 for receiving a grounding wire 281.

A pair of plastic insulating collars 242 are designed to fit into sleeves 216 and extend back to the openings 320 in housing block 214. Collars 242 have coaxial bores designed to receive connecting elements 220, which are very similar to the previously described connecting elements (elements 20 of FIG. 1), except that the rear portions of elements 220 have a simple integral wire lead 220A.

Figure 12:
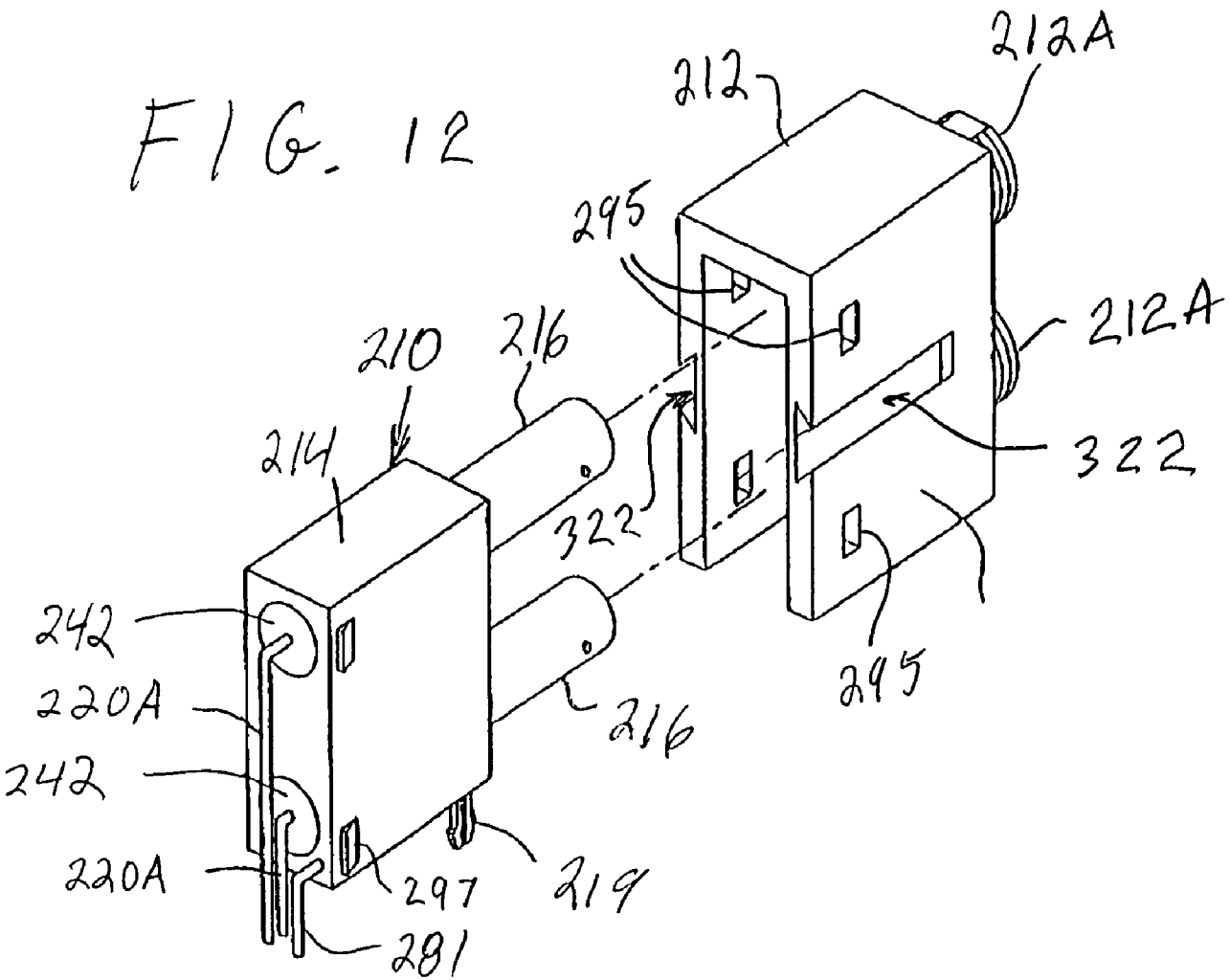
FIG. 12 is an exploded perspective view of the assembly of FIG. 11 with an insulating shell that is an alternate to that of FIG. 1.

Referring to FIG. 12, metallic housing 210 is shown assembled with insulating collars 242 mounted inside sleeves 216 and housing block 214. Previously mentioned wire leads 220A and grounding wire 281 are bent down and trimmed to extend below the bottom of housing block 214 an amount sufficient to allow connection to a printed circuit board (not shown).

An insulating shell 212 with a pair of threaded barrels 212A is designed to slide over metallic housing 210 and lock into place when stubs 297 snap into holes 295. In this embodiment there are no dovetail slots on housing block 214. Instead, a pair of dovetail slots 322 serving the same purpose are formed on opposite sides of shell 212.

Figure 13:
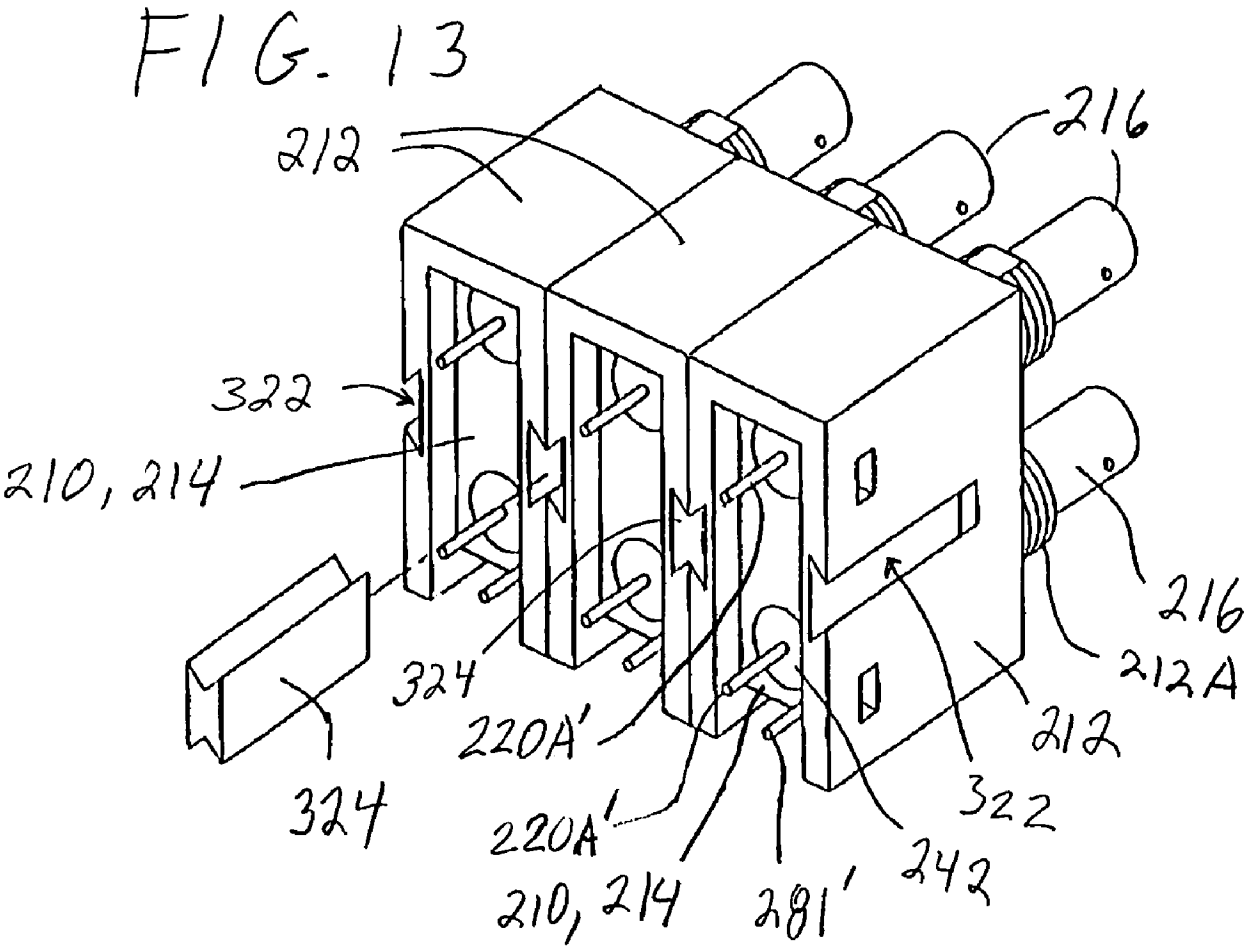
FIG. 13 is an exploded perspective view of a trio of matching assemblies as per FIG. 12 that are attached together with a dovetailed insert.

Referring to FIG. 13, three identical sets of the components of FIG. 12 are shown assembled but with differently configured wire leads 220A' and grounding wire 281'. Specifically, leads 220A' and wire 281' are not bent and extend rearwardly an amount sufficient to allow connection to a printed circuit (not shown). In contrast to the embodiment of FIG. 12, the connector sleeves 216 will be oriented perpendicular to the circuit board.

The three illustrated identical assemblies are attached together with inserts 324 having a "butterfly" cross-section, that is, an opposing pair of dovetail ridges designed to fit into the dovetail slots 322 on the sides of shells 212.

Figure 14:
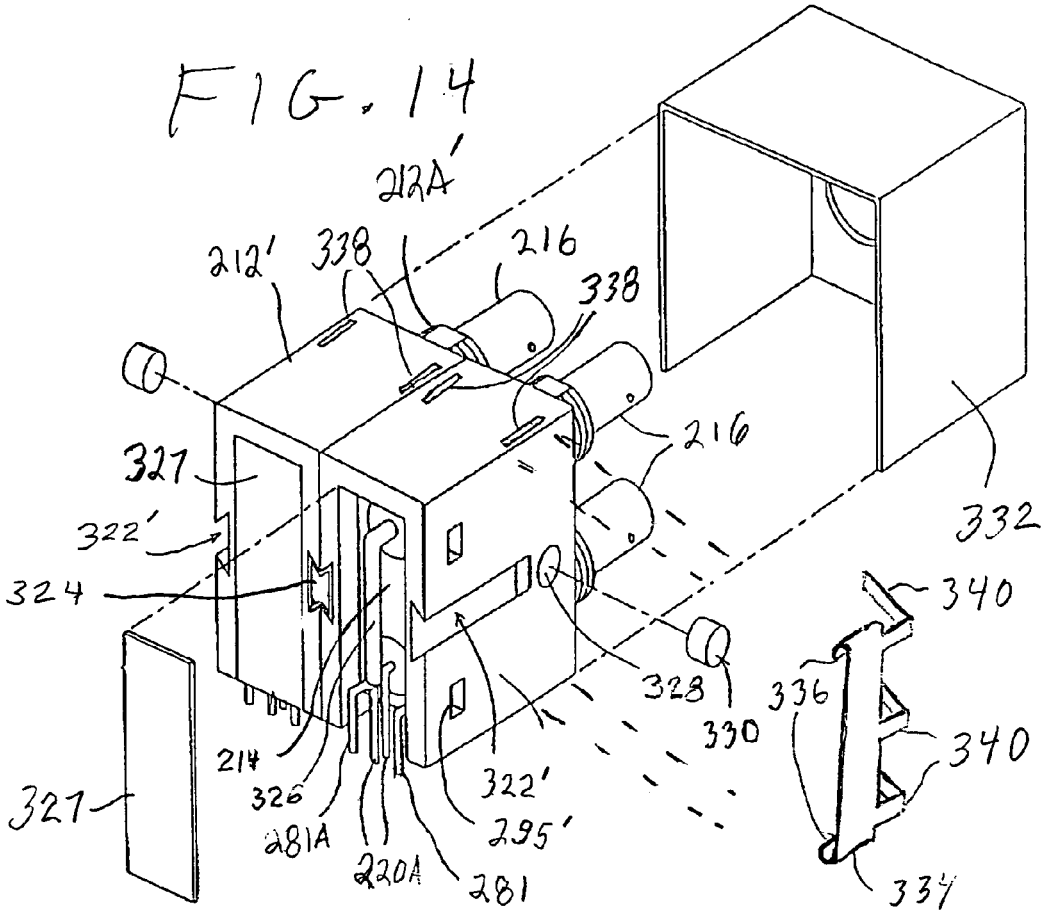
FIG. 14 is an exploded perspective view of a pair of matching assemblies as per FIG. 12 that are attached together and fitted with additional components.

Referring to FIG. 14, the components shown in FIG. 12 have been modified, paired, and attached together as a pair by means of previously mentioned insert 324. In this embodiment, one of the leads 220A has been fitted with an insulating sleeve 326. Also, another grounding wire 281A has been attached to housing block 214 to supplement the other grounding wire 281. A metallic backplate 342 sized to fit inside the rear opening a shell 212' provides enhanced shielding.

Also, in comparison to the previously mentioned shell (shell 212 of FIGS. 12 and 13) an aperture 328 has been formed in the side of shell 212' to receive a capacitive element 330. When slid over sleeves 216 and shell 212', the sheet metal structure 332 is capacitively coupled through element 330 to the metallic housing block 214. Thus, if the assembly is then fastened onto a metal panel (not shown) by threading a nut onto threaded sleeves 212A', the metal panel will touch structure 332 and thus have a local high frequency ground connection through capacitive element 330 through housing block 214 and ground wires 281 and 281A.

In some embodiments structure 332 may be replaced with a metal strap structure 334 having lips 336 designed to snap into slots 338 on the top and bottom of shell 212'. Strap structure 334 also has a trio of springy arms 340 that reach around to the front of shell 212' in order to electrically contact a metal panel (not shown) to which the assembly may be attached as described before.

To facilitate an understanding of the principles associated with the foregoing apparatus, the assembly and operation of the connector of FIGS. 1–9 will be briefly described, although it will be appreciated that the description for the other embodiments will be similar.

The cable 34 can be soldered to connecting element 20 before forming knob 36 around the soldered joint, as shown in FIG. 10. Thereafter, insulating collar 42 can be forced onto connecting element 20, moving into abutment with knob 36 as annular ridge 40 is wedged and locked into the collar. The annular clip 60 can be slid onto cable 34 and pushed over knob 36 until bights 60B snap into slots 38. In some embodiments metal clip 60 will contact braided shield 46 of cable 34, in which case the distal end of the shield will be grounded to the housing 10, although in most embodiments such a grounding connection will not be made through clip 60. Cable 34 can then be inserted through receptacle 18 (FIG. 1) and through tunnel 61 until clip 60 reaches the illustrated position wherein bifurcated arm portion 60C is wedged in place deep within receptacle 18.

The unconnected ends of the center lead 32 and braid 46 of cable 34 can be soldered into the barrels 50 and 51 of the contact elements 52 and 54, as shown in FIG. 10. If desired, carrier 56 can be molded around these contact elements, although in some embodiments these contact elements will maintain a desired position due to the restricted space existing in recess 58 (FIG. 1).

In addition, ground wires can be inserted into portals 80 and 82. The tip of the inserted wire can be held in place by being bent or soldered through an associated opening, such as opening 84. The installed ground wires can be bent down.

Thereafter, shell 12 can be slid over metal sleeves 16 and into the position shown in FIG. 1. Slots 66 on the bottom of shell 12 avoid interference with pins 52 and 54, wire 81 and stake 19. The back of shell 12 can be closed by pressing cover 94 in place so that overhang 96 rests on ridges 88 and 90, and pins 98 fit into holes 92.

The connector assembly can be initially secured to the printed circuit board 21 by pressing stake 19 through a hole in the circuit board 21. Simultaneously, pins 52 and 54 and the previously mentioned ground wires (for example ground wire 81) will also be inserted through corresponding holes in the circuit board 21. These components inserted into circuit board 21 can then be soldered using conventional techniques such as flows soldering.

The circuit board 21 may be assembled so that it is adjacent to a metal panel 64 (FIG. 1) which may be designed with openings through which sleeves 16 and threaded barrel 12A are inserted. The panel openings may have flat portions that match the flats 12B on threaded barrels 12A.

An end user can use the illustrated connector by attaching a mating connector (for example, an unillustrated BNC connector) that has a center pin that fits between the fingers 22 of connecting element 20. This mating connector will also have an outer female shell that fits around metal sleeve 16 and locks onto stubs 16A.

High frequency signals can be conveyed through the illustrated connector. Shielded coaxial cables 34 will have an impedance that matches the impedance of devices attached to the connector to avoid reflections and losses. Cables 34 will maintain good transmission characteristics including low EMI that will not be appreciably degraded by the cable positioning or by the fact that the cables make sharp turns. In particular, the lower cable 34 of FIG. 1 will make a tight pigtail turn, but this tight turn will not significantly degrade the cable's performance.

In some instances it will be desirable to color-code shell 12 so a user can quickly identify different connectors. Still, in some cases the connector assembly of FIG. 1 will be installed with an incorrectly colored shell 12. Nevertheless, shell 12 can be pushed off metal housing 10 by prying the sides of the shell clear of locking stub 97. The slots 66 will provide clearance so that pins 52 and 54 and stake 19 will not prevent removal of shell 12. The replacement shell can be installed simply by slipping it over housing 10 and locking the shell on stubs 97.

It will be appreciated that metal housing 10 need hot be fitted with shielded cables and instead, simple insulated (or uninsulated) wires can be routed from cavity 30 of element 20 through tunnel 61 and into the barrels 50 of the contact element. In such designs care must be taken to bend the wire with a radius of curvature that avoids losses, radiation, and reflection, but this requirement may not be very demanding in low-frequency applications.

It will also be appreciated that metal housing 10 need not be oriented as shown in FIG. 1 but may instead use leads that leave tunnel 61 without bending so that sleeves 16 are perpendicular to circuit board 21 as with the embodiment of FIG. 13.

It will further be appreciated that the connector assembly of FIG. 1 can be mated with an identical assembly by using the insert 104 of FIG. 9. Having a central plate, insert 104 engages a relatively wide region to prevent rocking of the adjacent connector assemblies.

It will be appreciated that various modifications may be implemented with respect to the above described, preferred embodiments. While the illustrated metal housings are cast to provide a pair of connectors, other embodiments may provide more connectors or just a single connector. While external connectors are secured to the illustrated connectors by stubs on the metal sleeves, other connectors may be secured by threading, bayonet fittings, force fitting, etc. The illustrated insulating shell is optional as is the capacitive element, metal backplate, grounding wire etc. The connectors can be mounted on printed circuit boards or other circuit boards in which the connections may be made by wire wrapping, screw terminals, by receiving a pin previously mounted on the circuit board into sockets on the connector assembly, etc. Also, the size, shape and other dimensions of the connector can be varied depending on the desired strength, power rating, frequency rating, etc.

Obviously, many modifications and variations of the present invention are possible in light of the above teachings. It is therefore to be understood that within the scope of the appended claims, the invention may be practiced otherwise than as specifically described.

What is claimed is:

1. A connector assembly comprising:

a casing including a metallic housing and adapted for mounting on a circuit board, said metallic housing having at least one receptacle;

at least one connecting element mounted at said at least one receptacle;

an interconnect attached to said casing and having a plurality of contact elements adapted to contact the circuit board;

a shielded cable connected between said connecting element and said interconnect, said shielded cable having a central lead and a coaxial shield both separately connected to corresponding ones of said contact elements; and an annular clip for engaging said receptacle and holding said connecting element in place therein.

2. A connector assembly according to claim 1 wherein said shielded cable is rated to carry signals at over 2 GHz.

3. A connector assembly according to claim 1 wherein said annular clip encircles said cable and connects said coaxial shield to said metallic housing proximate said receptacle.

4. A connector assembly according to claim 1 wherein said at least one receptacle comprises a plurality of receptacles, said at least one connecting element comprising a plurality of conductive elements each in a corresponding one of said receptacles.

5. A connector assembly according to claim 4 wherein said metallic housing has said receptacles on one side and on the opposite side has a recess that contains said shielded cable, said metallic housing having a metallic backplate for covering said recess.

6. A connector assembly according to claim 4 wherein said shielded cable comprises a plurality of shielded cabling lines, one for each of said receptacles, each of said cabling lines (a) being rated to carry signals at over 2 GHz, and (b) having a central lead and a coaxial shield both separately connected to corresponding ones of said contact elements.

7. A connector assembly according to claim 1 wherein said receptacle comprises a metal sleeve surrounding said at least one connecting element.

8. A connector assembly according to claim 7 comprising:

an insulating collar fastened around a distal end of said connecting element.

9. A connector assembly according to claim 1 wherein said interconnect comprises a carrier with openings sized to hold said contact elements, said metallic housing having a hollow for holding said carrier.

10. A connector assembly according to claim 1 comprising:

an insulating shell sized to fit around said metallic housing.

11. A connector assembly according to claim 10 wherein said shell is slidably removable from said metallic housing.

12. A connector assembly according to claim 10 wherein said shell is slidably removable from said metallic housing after said contact elements are attached to the circuit board.

13. A connector assembly according to claim 10 wherein said shell is slidably removable from said metallic housing, and wherein said shell has at least one subjacent slot giving said contact elements clearance when said shell is being removed.

14. A connector assembly according to claim 1 wherein said casing has a dovetail slot, said connector assembly comprising:

an insert having on opposite sides a dovetail ridge sized to slide into said dovetail slot, so that by means of said dovetail ridges on said insert said casing can be attached to a similar casing with a similar dovetail slot.

15. A connector assembly according to claim 14 wherein said insert has a center plate with said dovetail ridges projecting from opposite sides of said center plate.

16. A connector assembly comprising:

a casing including a metallic housing and adapted for mounting on a circuit board, said metallic housing having a plurality of receptacles;

a plurality of connecting elements each mounted in a corresponding one of said receptacles;

an interconnect attached to said casing and having a plurality of contact elements adapted to contact the circuit board; and a plurality of shielded cables, one for each of said receptacles, connected between said plurality of connecting element and said interconnect, each of said plurality of shielded cables (a) being rated to carry signals at over 2 GHz, and (b) having a central lead and a coaxial shield both separately connected to corresponding ones of said contact elements, said shield of each of said cables being connected to said metallic housing proximate said receptacles.

17. A connector assembly according to claim 16 wherein said metallic housing has an external grounding tab adapted to attach to the circuit board.

18. A connector assembly comprising:

a casing including a metallic housing and adapted for mounting on a circuit board, said metallic housing having a plurality receptacles, said metallic housing having a grounding hole for receiving a ground line with sufficient clearance inside said casing to reach said interconnects;

a plurality of connecting elements each mounted in a corresponding one of said receptacles:

an interconnect attached to said casing and having a plurality of contact elements adapted to contact the circuit board; and a plurality of shielded cables connected between said connecting elements and said interconnect.

19. A connector assembly comprising:

a casing including a metallic housing and adapted for mounting on a circuit board, said metallic housing having at least one receptacle;

at least one connecting element mounted at said at least one receptacle, said receptacle comprising a metal sleeve surrounding said at least one connecting element;

an insulating collar fastened around a distal end of said connecting element;

an insulating knob fitted around a proximal end of said connecting element;

an annular clip for engaging said receptacle and holding said insulating knob in place therein;

an interconnect attached to said casing and having a plurality of contact elements adapted to contact the circuit board; and a shielded cable connected between said connecting element and said interconnect.

20. A connector assembly comprising:

a casing including a metallic housing and adapted for mounting on a circuit board, said metallic housing having at least one receptacle;

at least one connecting element mounted at said at least one receptacle, said receptacle comprising a metal sleeve surrounding said at least one connecting element;

an insulating shell sized to fit around said metallic housing, said shell having a threaded barrel sized to encompass at least a portion of said metal sleeve;

an interconnect attached to said casing and having a plurality of contact elements adapted to contact the circuit board; and a shielded cable connected between said connecting element and said interconnect.

21. A connector assembly according to claim 20 comprising:

a capacitive element, said shell having an aperture sized to hold said capacitive element; and a metal structure for holding said capacitive element in said aperture against said metallic housing, said structure extending to a position adjacent said threaded barrel, so that the connector assembly can be mounted on a conductive panel that is then capacitively coupled to said metallic housing.

22. A connector assembly method employing a plurality of variously colored insulating shells and a metallic housing having a receptacle and contact elements, said shells having an aperture, the method comprising the steps of:

bringing the metallic housing to the vicinity of a circuit board;

selecting one of the variously colored insulating shells and fitting it around the metallic housing;

connecting the contact elements to the circuit boards;

installing a capacitive element in the aperture of the shell to contact said metallic housing;

attaching a conductive element that reaches from the capacitive element to a position adjacent the receptacle; and attaching the receptacle of the metallic housing at an opening in a metal panel to make continuity from it through said conductive element to said capacitive element.

23. A connector assembly method according to claim 22 comprising the step of:

sliding the selected one of said variously colored insulating shells off said metallic housing; and selecting another one of the variously colored insulating shells and fitting it around the metallic housing while installed on the circuit board.

* * * * *